US010667588B2

(12) United States Patent
Chan et al.

(10) Patent No.: US 10,667,588 B2
(45) **Date of Patent: *Jun. 2, 2020**

(54) MULTIPLE TRANSACTION CARD HOLDER AND DISPENSER

(71) Applicants: Ronald Chi-Yin Chan, Coquitlam (CA); Yau Sing Hubert Sin, Coquitlam (CA); Brian Hiyin Lee, Delta (CA)

(72) Inventors: Ronald Chi-Yin Chan, Coquitlam (CA); Yau Sing Hubert Sin, Coquitlam (CA); Brian Hiyin Lee, Delta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/247,415

(22) Filed: Jan. 14, 2019

(65) Prior Publication Data

US 2019/0387853 A1 Dec. 26, 2019

Related U.S. Application Data

(63) Continuation-in-part of application No. 15/817,892, filed on Nov. 20, 2017, now Pat. No. 10,178,901.

(60) Provisional application No. 62/423,916, filed on Nov. 18, 2016.

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01); *A45C 2001/067* (2013.01)

(58) Field of Classification Search
CPC . A45C 11/18; A45C 11/182; A45C 2001/065; A45C 2001/067; A45C 1/06; B65D 83/12; G07D 9/004
USPC ..... 206/39, 394.4, 39.5, 38, 449, 555
See application file for complete search history.

(56) References Cited

U.S. PATENT DOCUMENTS 4,305,497 A * 12/1981 Pacilio ..... G07D 1/08 206/0.81
4,647,118 A * 3/1987 Kamperman ..... G11B 33/04 206/308.1
4,817,253 A * 4/1989 Harmatuik ..... A45C 11/182 150/137
4,887,739 A * 12/1989 Parker ..... A45C 11/18 221/232
D324,305 S * 3/1992 Prey ..... B65D 83/0829 D3/247
5,720,386 A * 2/1998 Allsop ..... G11B 23/0317 206/308.1
5,740,624 A * 4/1998 Baseley ..... A45C 11/182 40/27.5

(Continued)

*Primary Examiner* — Chun Hoi Cheung
*Assistant Examiner* — Brijesh V. Patel
(74) *Attorney, Agent, or Firm* — Dean Craine

(57) ABSTRACT

A card holder for storing a plurality of transaction cards its a stacked configuration inside a case with an internal frame, a side opening and a lower opening. The lower frame is configured to hold a stack of transaction cards. Formed on a face of the case is a finger slot that allow the user to manually rotate the cards when in a stacked configuration inside the case so that the top edge of the cards are staggered and fan outward through a side opening. The lower opening on the case is configured so that when the cards fan outward through the side opening, the lower corners of the cards extend through the lower opening.

7 Claims, 8 Drawing Sheets

(56) References Cited

U.S. PATENT DOCUMENTS

| | | | | |
|---|---|---|---|---|
| 2002/0074246 | A1* | 6/2002 | Tiscione | A45C 11/182 206/39.4 |
| 2005/0224149 | A1* | 10/2005 | Tiscione | A45C 11/182 150/148 |
| 2012/0067747 | A1* | 3/2012 | Van Geer | A45C 11/182 206/39 |
| 2013/0025750 | A1* | 1/2013 | Wingerter | A45C 1/02 150/149 |
| 2014/0014676 | A1* | 1/2014 | Minson | B65D 83/0829 221/226 |
| 2015/0282580 | A1* | 10/2015 | Chen | A45C 11/182 206/425 |
| 2015/0335118 | A1* | 11/2015 | Van Geer | A45C 11/182 150/147 |

* cited by examiner

MULTIPLE TRANSACTION CARD HOLDER AND DISPENSER

This is a continuation of part application of U.S. utility patent application, (application Ser. No. 15/817,892), filed on Nov. 20, 2017, now U.S. Pat. No. 10,178,901 issued on Jan. 15, 2019, which was based on and claimed the filing date benefit of U.S. provisional patent application (62/423,916) file on Nov. 18, 2016.

BACKGROUND OF THE INVENTION

1. Field of the Invention

This invention relates to devices used for carrying multiple membership club cards, identification cards, or transaction cards, in a compact, stacked configuration that selectively presents the cards so they may be easily identified in the stack and removed from the tack when desired.

2. Description of the Related Art

Personal membership cards, identification cards, credit cards, and debit cards, (collectively called 'transaction cards' hereinafter) are typically stored in a plurality of slots or pockets formed on the inside surfaces of a wallet. The slots or pockets are aligned in parallel rows on one or both leaves on the wallet. When cards are placed individually inside a slot or pocket, the top edges of the cards are offset and visible. Unfortunately, seeing only the top edge of a transaction card may not be sufficient to determine its identity. Also, because the pockets hold one or more transactions cards, the top transaction card in the slot or pocket prevents viewing of the lower cards. To identify the lower transaction cards in the pocket, the upper cards must be removed or repositioned in the slot or pocket.

Today, individuals sometimes must remove their transaction cards from their wallets using one hand. When the transaction cards are stored in slots or pockets in the wallets described above, identifying and removing the transaction cards from the slots or pockets with one hand is difficult.

SUMMARY OF THE INVENTION

These and other objects are met by an improved multiple transaction card holder used to store a plurality of transaction cards a compact, stacked alignment inside a compact case and then that selectively displays the transaction cards in a 'fan-like' manner to expose the side edges and top corners of each card enabling the cards to be easily identified and easily removed from the stack.

The case includes a narrow, interior frame located between a front panel and a rear panel. The interior frame is sufficient in height, width and depth to form a partially closed cavity between the two panels. The closed cavity is configured to hold a stack of longitudinally aligned transaction cards.

In the first and second embodiments, the interior frame includes a lower frame and an upper frame. Formed on a longitudinal side leg on the lower frame is an inward extending, vertical abutment surface used to keep the transaction cards stacked and longitudinally aligned inside the closed cavity. The lower frame also includes a transverse leg perpendicularly aligned to the longitudinal side leg. Formed or attached to the transverse leg is an upward extending flexible arm. During use, the stack of transaction cards is positioned longitudinally inside the closed cavity so the cards' longitudinal edges presses against the abutment surface and the lower edges of the transaction cards rests over the flexible arm. The lower frame includes an outer leg parallel to the side leg which forms a side opening on the case.

The upper frame is attached to the top edges of the front and rear panels. The upper frame forms the top surface of the case and acts to retain the stacked cards inside the closed cavity. The upper frame includes a lever pivot.

Disposed over and pivotally attached to the upper frame is an L-shaped lever arm. The lever arm includes a handle arm, a center hub and a push arm perpendicularly aligned with the handle arm, During assembly, the lever arm is aligned so the handle arm is disposed above the upper frame and the push arm extends into the case's closed cavity. The center hub receives the lever pivot formed on the upper frame to pivotally connect the lever arm to the upper frame.

The push arm extends downward into the closed cavity so its inside edge is aligned with the abutment surface on the lower frame, Formed on a transversely aligned surface on the push arm are a plurality of sequentially aligned, offset steps. The steps are arranged in an incline direction from the center hub to the push arm's distal. When the push arm is rotated, each step is configured to press against the adjacent inside edge on one of the transaction cards aligned in the stack. When the distal end of the handle arm is lifted, the steps move in arcs with different radii and force the transaction cards adjacent to the steps laterally different distances. The flexible arm on the lower frame is configured to facilitate rotation of the cards as the push arm moves in an arc causing the transaction cards to be dispensed in a fan-like manner through the side opening on the case, similar to the way a set of playing cards are held in a person's hand. When arranged in this manner, the outside longitudinal edge and upper corner of each transaction cards is exposed making it easier to identify each card and easier to remove and return the card to the stack.

Also disclosed is a third embodiment of the multiple card holder and dispenser with the lever arm and push arm eliminated. In this embodiment, the user uses his fingers to force the upper corners of the cards through a diagonal side opening. Formed adjacent to the upper section of the diagonal side opening is a finger opening. The card holder and dispenser includes a modified interior frame that supports the cards in a stacked position inside the case. Formed on the bottom surface of the case is a bottom opening. The interior frame is configured to facilitate rotation of the cards inside the case. During use, the cards rotate inside the case so that the upper corners of the cards are staggered and extend through the side opening. Simultaneously, the lower corners of the cards are staggered and extend through a lower opening.

Also disclosed is a fourth embodiment of the multiple card holder and dispenser similar to the first embodiment that uses a lever arm with a handle arm and a push arm. Formed on the push arm are staggered steps. A torsion spring is attached to the pivot point that provides more consistent return action of the lever arm.

In the fourth embodiment, a modified inner frame is used that hold the stack cards in longitudinal alignment inside the case. The inner frame includes a recessed curved surface and a raised lower frame with at least one diagonal arm formed on the lower frame that extends downward to form a resting corner. When the handle arm is rotated, the cards rotates and the upper corners are forced outward through the side opening. As the cards rotate, the the lower edges of some of the cards rotate over the lower frame.

DESCRIPTION OF THE PREFERRED EMBODIMENT(S)

Figure 17:
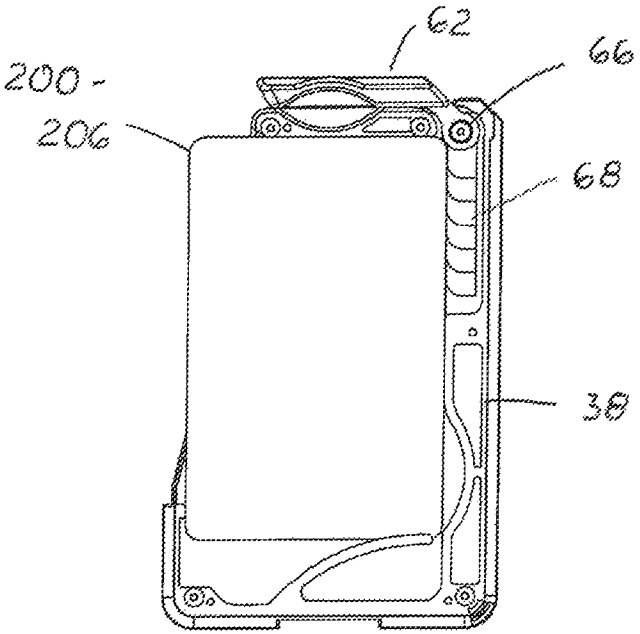
FIG. 17 is a sectional side elevational view of the multiple card holder and dispenser showing a stack of four transaction cards stored inside the case.

In the FIGS., there is shown an improved multiple transaction card holder 10 disclosed used to store a plurality of transaction cards 200, 202, 204, 206 (four transaction cards shown) in a compact, stacked alignment inside a case 12 as shown in FIG. 17. During use, the cards 200, 202, 204, and 206 are selectively moved inside the case 1 to that the top and lateral edges and the upper corners of the cards extend outward through a side opening 16 formed in the case 12 in a fan-like manner through the side opening 16. When presented in a fan-like manner, the top edge and the outer lateral edge of each transaction card are visible and exposed enabling the user to quickly identify the cards and then grasp the exposed upper corner or edge of desired card from the stack. After removal, the user can then easily reinsert the card back into the case and aligned with the stack.

The case 12 is a relatively thin structure that includes front flat panel 20, a rear flat panel 30 and an interior frame 38 sandwiched between the front panel 20 and the rear panel 30. The interior frame 38 includes a lower frame 40 and an upper frame 50. The lower frame 40 forms the case's side surface, the bottom surface, and the opposite short side surface. As discussed further below, the upper frame 50 is transversely aligned and affixed to the top edges of the front panel 20 and the rear panel 30 and forms the case's top surface.

Figure 18:
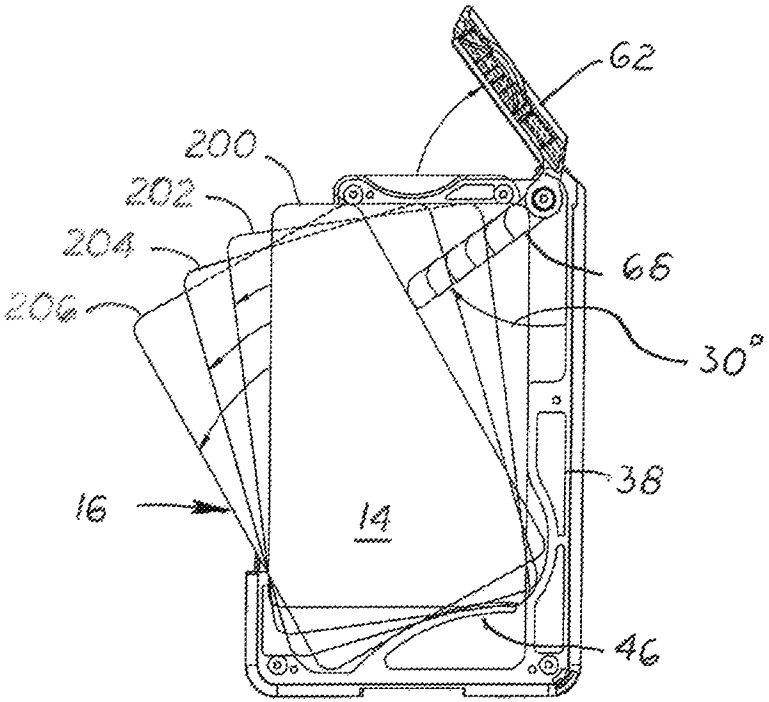
FIG. 18 is a sectional side elevational view of the multiple card holder and dispenser shown in FIG. 17 showing the lever arm pivoting upward a forcing the transaction cards outward from the case different distances.

More particularly, the lower frame 40 includes a longitudinal aligned long leg 42, a transverse leg 41, and a longitudinal aligned short leg 43, Formed on the long leg 42 near the long leg's midline axis is an abutment surface 45, The lower section of the long leg 42 is curves inward to accommodate the lower inside edges of the transaction cards 200, 202, 204, 206 as they fan outward as shown in FIG. 18. Formed on the transverse leg 41 is an inward extending flexible arm 46. The short leg 43 is perpendicularly aligned with the transverse leg 41 and parallel to the long leg 42. The length of the transverse leg 41 forms a closed cavity 14 that holds a stack of transaction cards may be positioned longitudinally inside the closed cavity 14 so the card's longitudinal edges presses against the abutment surface 45 and rests at least partially on the flexible arm 46.

The flexible arm 46 is a cantilevered structure attached or integrally formed at one end to the transverse leg 41. The flexible arm 46 includes a convex curved surface 47 that bends upward towards the long leg 42 and then flattens and extends transversely. During use, the flexible arm 46 supports part of the lower edges of the stack of cards. The flexible arm 46 is sufficiently flexible and pushes against the transaction cards when in a stacked configuration inside the closed cavity 14 to provide a snug fit against the push arm 68 discussed further below. The flexible arm 46 is also sufficiently flexible to apply a slight upward force to the stack of cards when the cards are moved laterally by a push arm 68. In the embodiment in the Figs, a void space 48 is formed under the flexible arm 46 that enables the flexible arm 46 to bend downward when the stack of cards are loaded into the case 12. Formed between the flexible arm 46 and the short leg 43 is a card receiving space 44. Together, the card receiving space 44 and the flexible arm's convex surface 47 enables the stack of cards to rotate inside the case 12 so the top edges and the lateral edges of the cards are exposed through the side opening 16.

The upper frame 50 is attached to the top edges of the front panel 20 and the rear panel 30 with screws discussed further below. The upper frame 50 retains the stacked cards inside the closed cavity 14. Disposed inside a space adjacent and above the upper frame 50 is a lever pivot 52. During assembly, the lever pivot 52 is sandwiched between the front and rear panels 20, 30, respectively, and held in a fixed position on the case 12. It should be understood that lever pivot 52 may be integrally formed on the upper frame 50.

Disposed over the upper frame 50 is an L-shaped lever arm 60 that includes a handle arm 62, a hollow center hub 66 and a push arm 68. During assembly, the lever arm 60 is aligned so the handle arm 62 is disposed above the upper frame 50 and the push arm 68 extends into the case's closed cavity 14. During assembly, the center hub 66 receives the lever pivot 52 to pivotally connect the lever arm 60 to the case 12.

Figure 1:
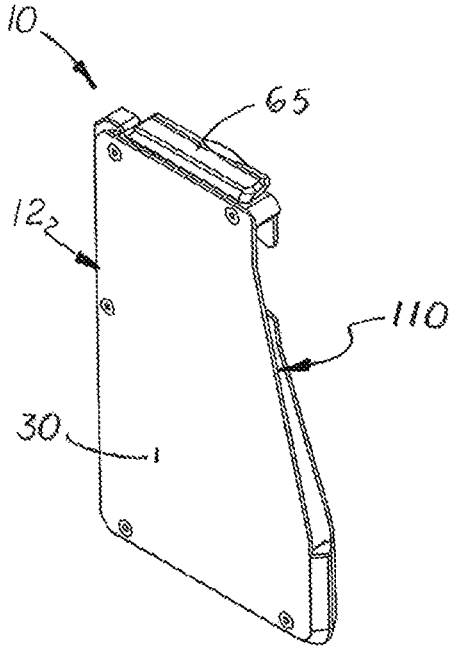
FIG. 1 is a rear perspective of a first embodiment of a multiple card holder and dispenser.
Figure 2:
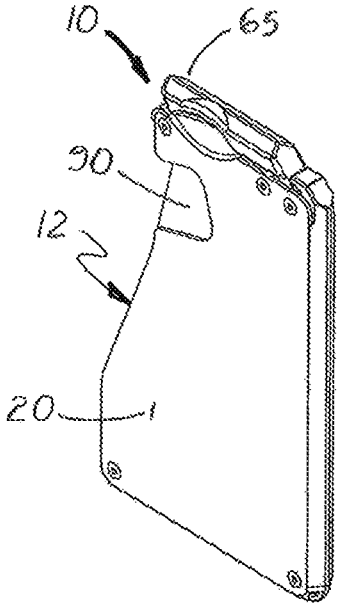
FIG. 2 is a front perspective of a first embodiment of the multiple card holder and dispenser shown in FIG. 1.
Figure 3:
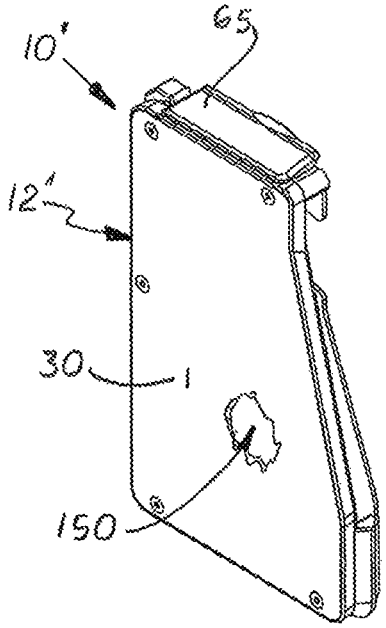
FIG. 3 is a rear perspective of a second embodiment of a multiple card holder and dispenser.
Figure 4:
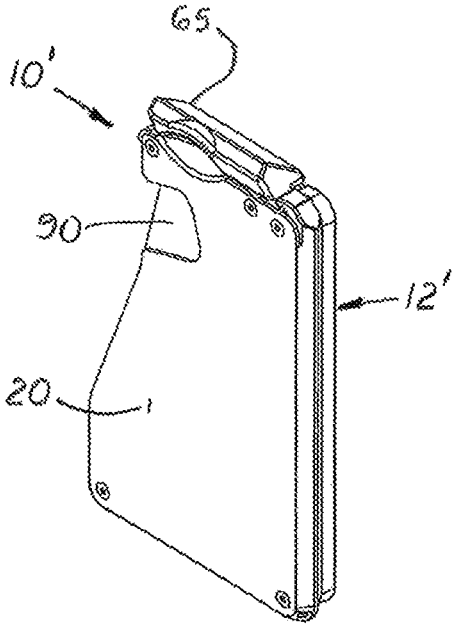
FIG. 4 is a front perspective of a second embodiment of the multiple card holder and dispenser shown in FIG. 3.
Figure 5:
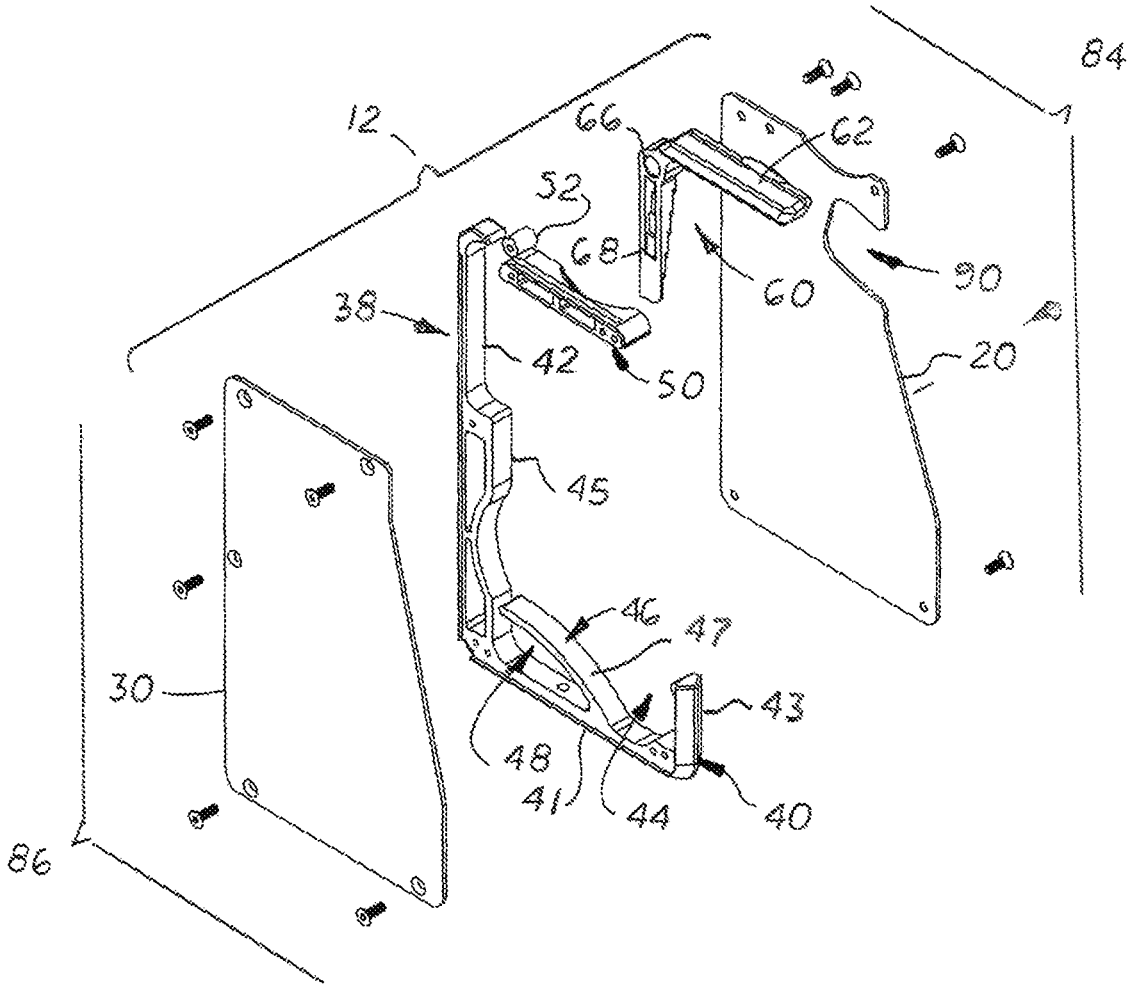
FIG. 5 is an exploded rear perspective of the first embodiment of the multiple card holder and dispenser.
Figure 6:
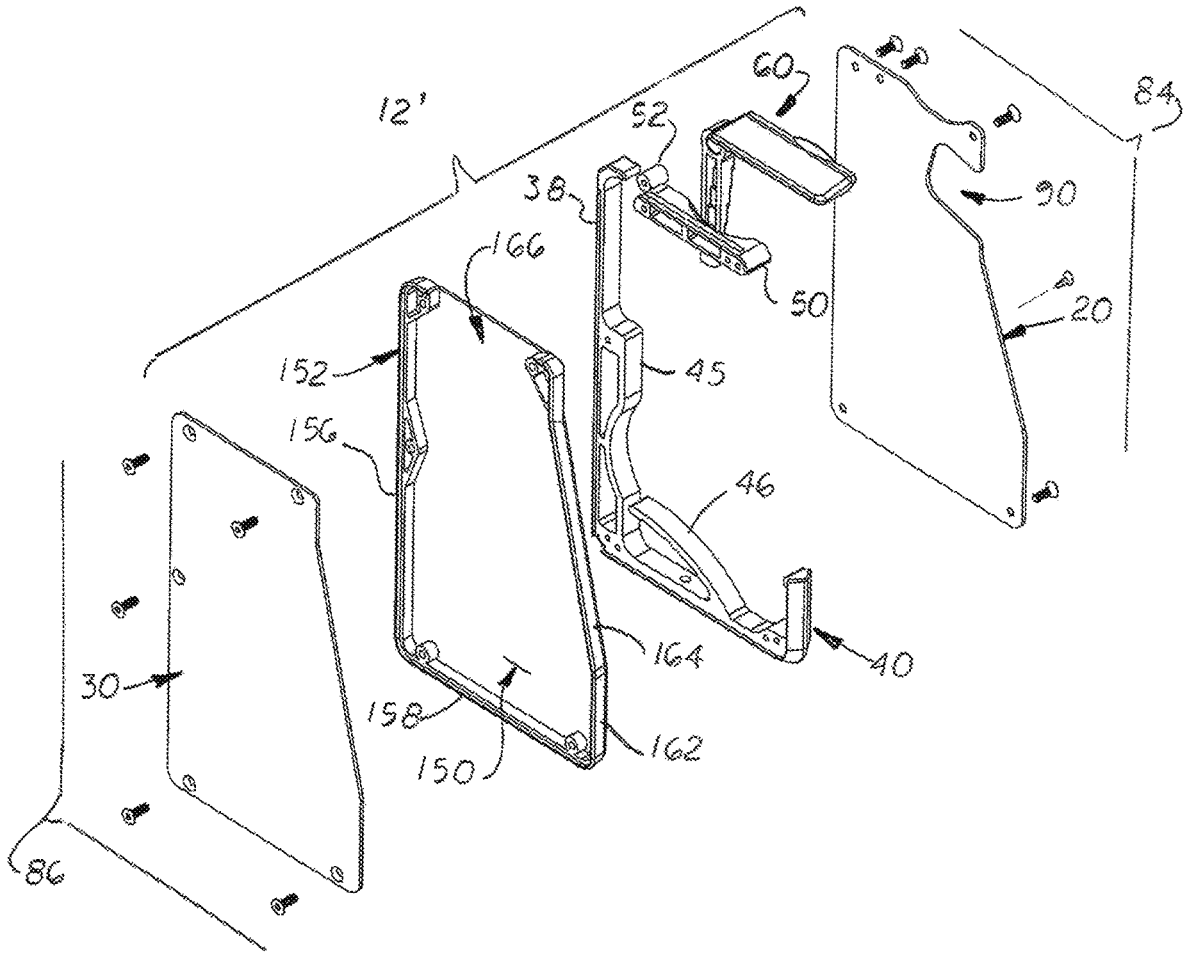
FIG. 6 is an exploded rear perspective of the second embodiment of the multiple card holder and dispenser with an enlarged case with a coin cavity.
Figure 7:
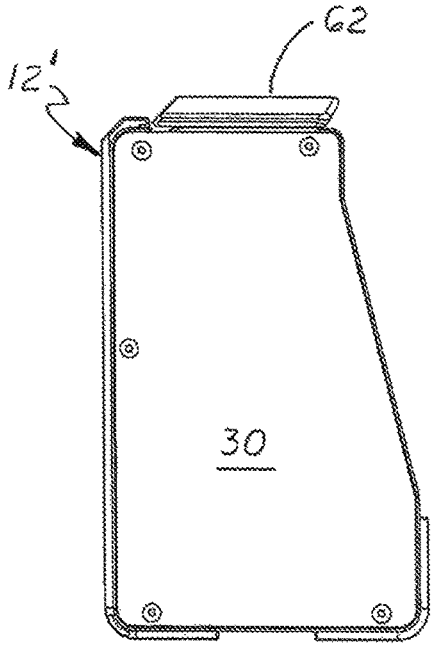
FIG. 7 is a rear elevational view of the multiple card holder and dispenser shown in FIG. 6.
Figure 8:
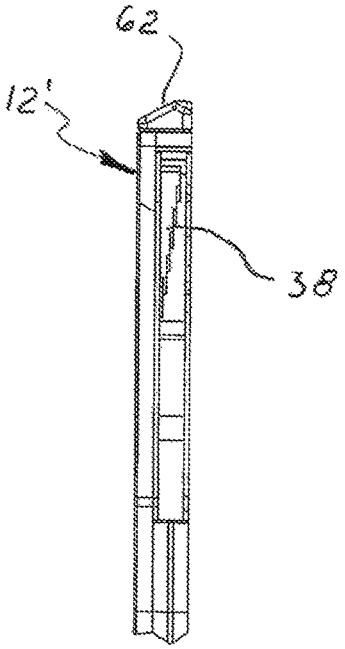
FIG. 8 is a left elevational view of the second embodiment of the multiple card holder and dispenser.
Figure 9:
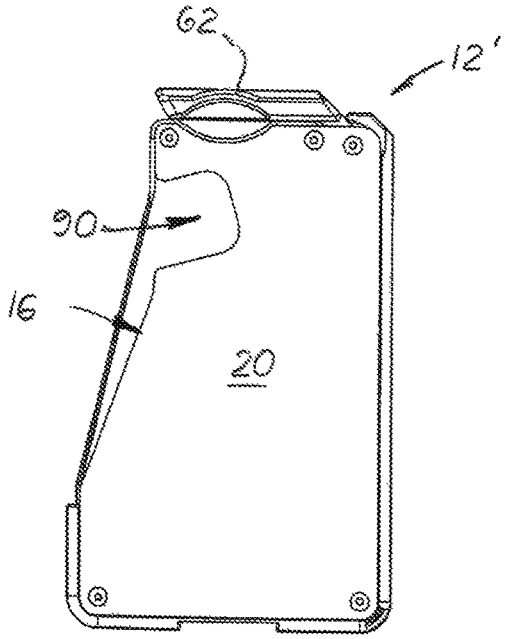
FIG. 9 is a front elevational view of the multiple card holder and dispenser shown in FIG. 6-8.
Figure 10:
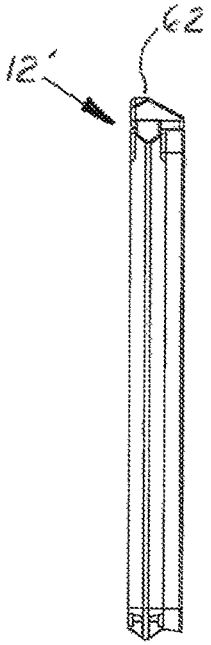
FIG. 10 is a right side elevational view of the multiple card holder and dispenser shown in FIGS. 6-8.
Figure 11:
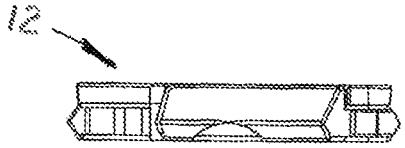
FIG. 11 is a top plan view of the multiple card holder and dispenser shown in FIG. 6-10.
Figure 12:
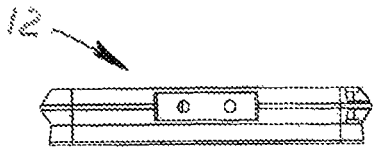
FIG. 12 is a bottom plan view of the multiple card holder and dispenser shown in FIG. 6-11.
Figure 13:
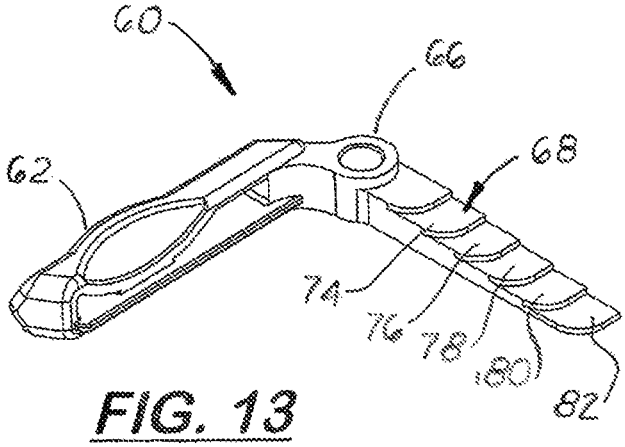
FIG. 13 is a perspective view of the lever arm.
Figure 14:
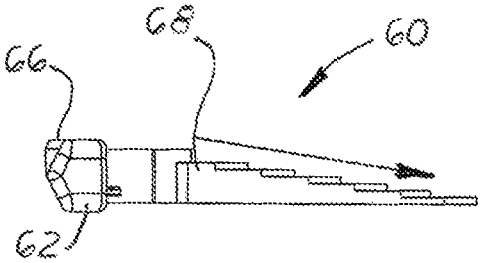
FIG. 14 is a left elevational view of the lever arm.
Figure 15:
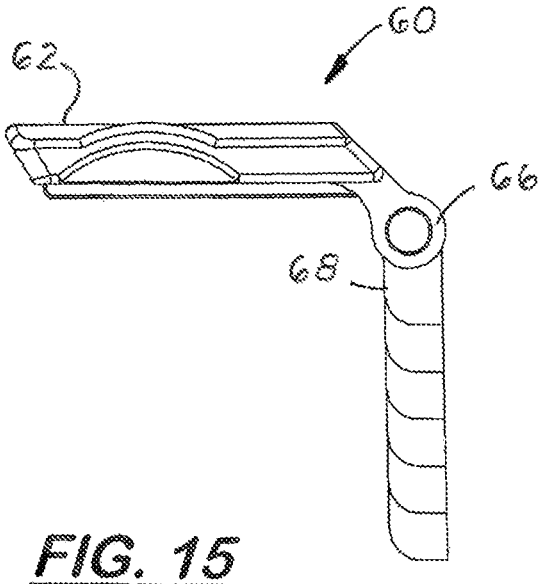
FIG. 15 is a top plan view of the lever arm.
Figure 16:
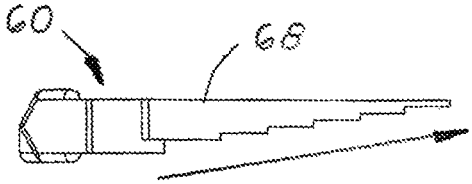
FIG. 16 is a right elevational view of the lever arm.

The push arm 68 has a thickness slightly smaller than the depth of the closed cavity 14. The rear surface (the surface adjacent to the rear panel 30) of the push arm 68 is flat so it slides freely over the inside surface of the rear panel 30. Formed on the opposite surface of the push arm 68 are a plurality of steps 74, 76, 78, 80, 82. The steps 74, 76, 78, 80, 82 are transversely aligned on the push arm 68 and configured to press individually against the adjacent edges of the transactions cards 200, 202, 204, 206 in the closed cavity 14 when the push arm 68 swings across the closed cavity 14. The number of steps formed on the push arm 68 may be adjusted to the maximum number of cards the holder carries. Because the steps 74, 76, 78, 80, and 82 moves in separate arcs with different radii, the opposite edges of the transaction cards 200, 202, 204, and 206 extend in a fan-like manner from the side opening 16 on the case 12. As shown in FIG. 13, in each step 74, 76, 78, 80, and 82 may have a curved outer edge that facilitates movement of the push arm 68 against the transaction cards.

Formed on the front panel 20 is an optional, diagonally aligned finger slot 90 that enables the user to insert a finger and force the top transaction card 200 in a stacked configuration laterally through the side opening 16.

The upper portions of the side edges of front panel 20 and rear panel 30 are diagonally aligned and form a diagonal side opening 16 sufficient in size and shape to allow the lateral edges of the transactions cards 200, 202, 204 and 206 to partially extend from the case 12.

There are two sets of 5 screws—a first set 84 used to attach the front panel 20 to the interior frame 38; and a second set 86 used to attach the rear panel 30 to the interior frame 38. The first set of screws 84 includes three top screws and two lower screws. One top screw extends through the front panel 20 and attached to the lever pivot 52. The two three top screws attach to two holes formed on the upper frame 50. When assembled, the upper frame 50 is held in a fixed position between the two panels 20, 30. The two lower screws on the first set 84 of screws attach to two holes formed on the lower edge of the interior frame 38.

The second set of screws 86 includes two top screws one intermediate screw and two lower screws. One top screw extends through the rear plate 30 and attaches to the lever pivot 52. The second top screw attaches to a hole formed on the upper frame 50, The intermediate screw attaches to a hole formed on the long leg 42 near the abutment surface 45 on the lower frame 40, The two lower screws in the second set of screws attach to two holes formed on the transverse leg 41 on the lower frame 40.

In a second embodiment of the multiple card holder 10' shown in FIGS. 6-10, a coin cavity 150 is formed inside a modified, enlarged case 12' and adjacent to the closed cavity 14 that houses the transaction cards 200, 202, 204, and 206. The case 12' includes a coin plate 152 mounted between the rear panel 30 and the interior frame 40. The coin plate 152 includes four surrounding frame members 156, 158, 162 and 164 that forms the two side panels and bottom panel. The top edge of the coin plate 152 is opened forming a coin opening 166 that communicates with the coin cavity 150. The second set of screws 86 are used to attach the coin plate 152 to the interior frame 38 and the rear panel 30. The edge of the lever arm 60 is used as a door to close the coin cavity 150. Rotating the lever arm 60 opens the coin cavity 150 and allows coins to be dispensed from the coin cavity 150.

Figure 19:
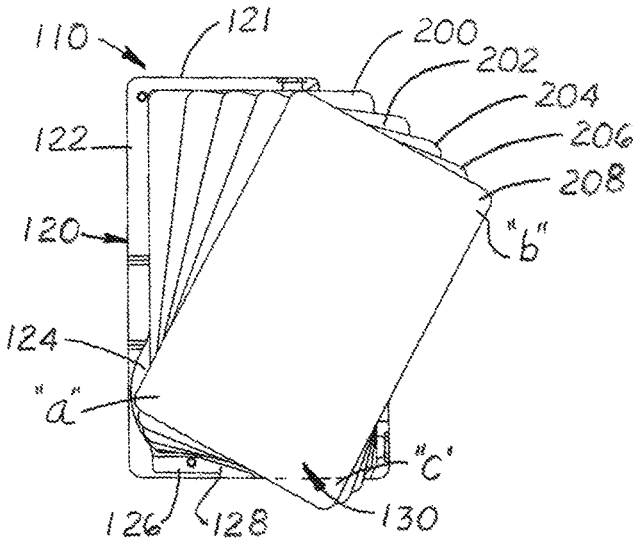
FIG. 19 is a front elevational view of another embodiment of the multiple card holder and dispenser with the front plate removed showing a plurality of stacked transaction cards located inside the case being rotated inside the case and the upper corner of the cards being extending through a side opening formed on the case.
Figure 20:
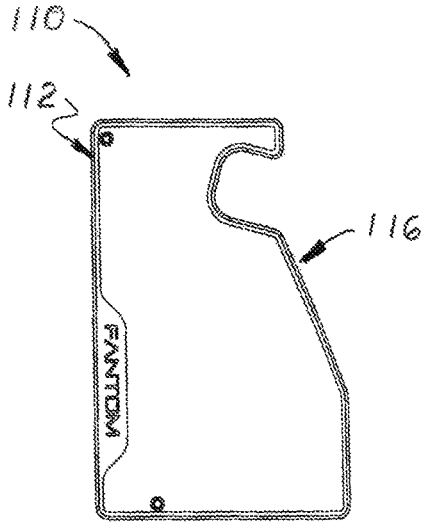
FIG. 20 is a from elevational view of the embodiment of the multiple card holder and dispenser shown in FIG. 19.
Figure 21:
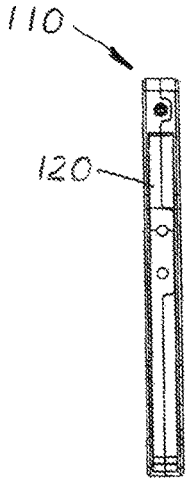
FIG. 21 is a right side elevational view of the embodiment of the multiple card holder and dispenser shown in FIGS. 19-20.
Figure 22:
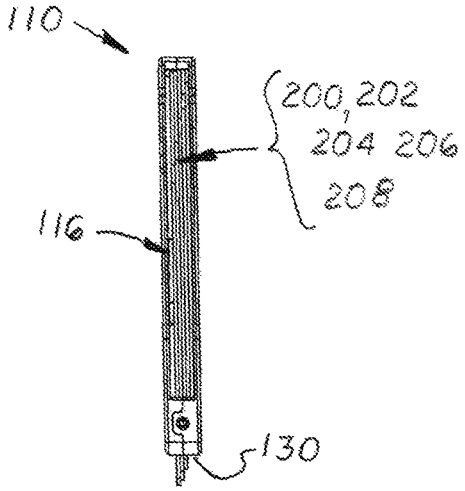
FIG. 22 is a left side elevational view of the embodiment of the multiple card holder and dispenser shown in FIG. 19.
Figure 23:
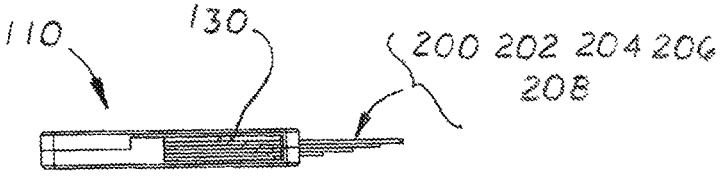
FIG. 23 is a bottom plan view of the multiple card holder and dispenser showing the cards being dispensed from the case.

Shown in FIGS. 19-23 is a third embodiment of the multiple card holder and dispenser, indicated by reference number 110, with the lever arm and push arm eliminated. With holder 110, the user uses only his fingers to force the upper corners of the cards 200, 202, 204, 206 and 208 through the side opening 116. The holder 110 includes a modified interior frame 120 that supports the cards 200, 202, 204, and 206 in a stacked position inside the case 112 and also facilitates their rotation of the cards 200, 202, 204, 206 and 208 so they partially extend through the side opening 116. More specifically, the interior frame 120 includes an upper transverse member 121 that extends over the top surface of the case. The interior frame 120 also includes a longitudinal leg 122 perpendicular aligned with the upper transverse member 121. Formed on the longitudinal leg 122 is a recessed area 124 that allows the first lower corner (indicated by reference letter "a") of the cards 200, 202, 204, 206 and 208 to rotate inward. The interior frame 120 also includes a lower transverse leg 126 that extends partially across the bottom edge of the case. The lower transverse leg 126 is configured to support said stacked transactions cards 200, 202, 204, 206 and 208 longitudinally aligned inside said case 112. Attached or integrally formed on the lower transverse leg 126 is a short diagonal member 128. The length and angle of the diagonal member 128 are sufficient to support said lower edges of said cards 200, 202, 204, 206 and 208 when said upper corners (indicated by reference letter "b") are extended through said side opening 116. The case 112 includes a lower opening 130 located adjacent to the diagonal member 129 that enables the lower corners (indicated by reference letter "c") of the cards 200, 202, 204, 206, and 208 to extend downward as shown in FIG. 19.

Figure 24:
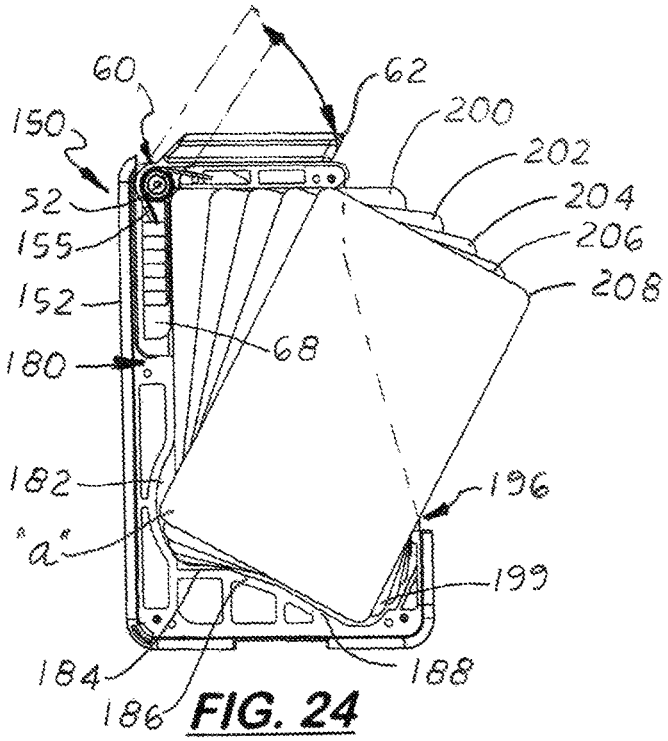
FIG. 24 is a front elevational view of another embodiment of the multiple card holder and dispenser with the front plate removed showing a plurality of stacked transaction cards located inside the case being forced laterally and rotating inside the case and extended through the side opening formed on the case.
Figure 25:
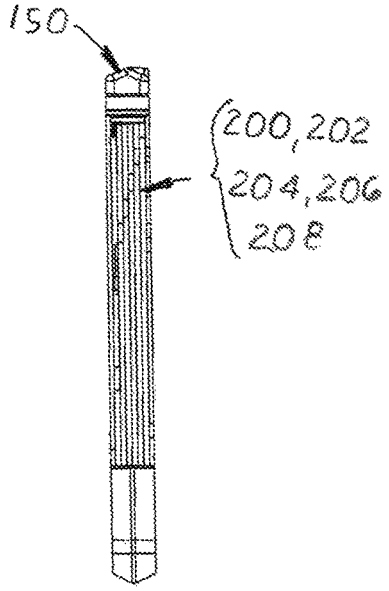
FIG. 25 is a right side elevational view of the case shown in FIG. 24 with the transaction cards stacked inside the case.
Figure 26:
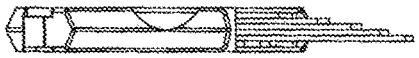
FIG. 26 is a top plan view of the multiple card holder and dispenser showing the cards being dispensed from the case.
Figure 27:
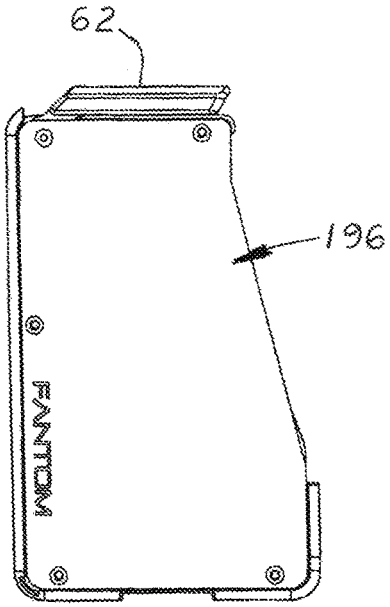
FIG. 27 is a front elevational view of the embodiment of the multiple card holder and dispenser shown in FIG. 19.
Figure 28:
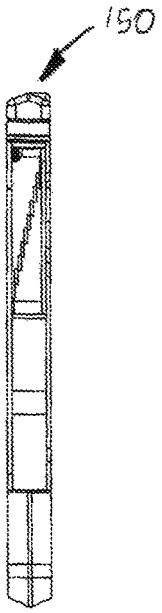
FIG. 28 is a right side elevational view of the case similar to the view shown in FIG. 25 with the transaction cards removed from the case.

Shown in FIGS. 24-28 is a fourth embodiment of the multiple card holder and dispenser, indicated by reference number 150 similar to the first holder 10. The holder 150 includes a torsion spring 155 mounted around the lever pivot 52 or hub that provides more consistent return action of the lever arm 60. The torsion spring 155 includes a center coil is placed around the lever pivot 52 and two lateral arms that connect to the handle arm and the push arm. The holder 150 also includes a modified interior frame 180 that supports the cards 200, 202, 204, 206 and 208 in a stacked position inside the case 152 and also facilitates their rotation of the cards 200, 202, 204, 206 and 208 so they partially extend through a large opening 196. Formed on the lever arm 60 are a plurality of transversely aligned steps (see FIG. 13) that are sequentially arranged with different thicknesses to form a downward incline plane towards the distal end of the push arm 68 so that when the handle arm 62 is lifted and the push arm 68 is rotated inside the closed cavity, each step moves in a different arc and presses against a side edge of one of the transaction cards 200, 202, 204, 206, 208 located adjacent to each step and forces one transaction card 200, 202, 204, 206 and 208 through the side opening 196. Together, the steps displaced the plurality of transaction cards 200, 202, 204, 206, 208 different amounts through the side opening 196 of the case 152 as shown in FIG. 24.

The interior frame 180 on holder 150 includes a lower transverse leg 184 configured to support the stacked transactions cards 200, 202, 204, 206, and 208 when longitudinally aligned inside the case 152. Attached or integrally formed on the transverse leg 182 is one or two short diagonal members 186, 188 configured to support the lower edges of the cards 200, 202, 204, and 206 and facilitate rotation of the cards 200, 202, 204, 206, and 208 so that the upper corner of each card extends through said side opening 196. Formed in the lower corner of the case 152 is a recessed void area 199 that receives the lower corner of one the outer transaction card 208.

In the embodiments shown herein, the cases 12, 12',112, and 152 are approximately 5 inches in length. The lower surface of each case 12, 12',112, and 152 is approximately 2½ in length and the top surface of each case is approximately 2 inches in length. In the holders 10, 110 and 150, the cases 12, 112 and 152 are approximately ½ inches thick. In the holder 10' with the coin cavity 150, the case 12' is approximately ¾ inches thick. The diagonal side edges of the front and rear panels on each case 12, 12',112, and 152 surrounding the side openings 16, 16',116, and 196 are aligned approximately 12 degrees from the longitudinal axis. The side openings 16, 16', 116, and 196 are approximately 3 inches in length. The finger slot 90 is approximately 1 inch in length and ¾ inches in width.

The handle arm is approximately 1.5 inches in length, and the push arm is approximately 1.5 inches in length.

In the embodiment shown, the push arm 68 is perpendicularly aligned with the handle arm 62. It should be understood that the handle arm 62 and push arm 68 may be disposed at different angles if the push arm 68 is longitudinally aligned on one side of the case 12 and the handle arm 62 is located outside the case 12.

the above embodiments, the card holders 10, 10' are shown and described as holding four transaction cards 200, 202, 204 and 206 and card holders 110, 150 are shown and described as holding five transaction cards 200, 202, 204, 206, and 208. It should be understood, the card holders 10, 10', 110, 150 are not limited to holding four or five transaction cards and can be manufactured in different sizes to hold different amounts of transaction cards.

In compliance with the statute, the invention described has been described in language more or less specific as to structural features. It should be understood, however, that the invention is not limited to the specific features shown, since the means and construction shown comprises only the preferred embodiments for putting the invention into effect. The invention is therefore claimed in any of its forms or modifications within the legitimate and valid scope of the amended claims, appropriately interpreted under the doctrine of equivalents.

We claim:

1. A holder for holding multiple transaction cards, comprising:

a. a case with a top surface;

b. a card cavity formed in said case configured to hold multiple transaction cards aligned longitudinally and in a stacked configuration, each transaction card includes a lower edge, a first lower corner, a second lower corner, and an upper corner opposite said first lower corner;

c. a side opening formed on said case providing access to said card cavity;

d. a lower opening formed on said case; and e. an interior frame located inside said case, said interior frame includes a longitudinally aligned long leg and a transverse leg, said long leg includes a recessed area configured to received said first lower corner of each transaction card when said transaction cards are aligned in a stacked configuration inside said case and rotated so that each upper corner of each transaction card may extend through said side opening, said transverse leg configured to support said lower edge of each transaction card when stacked and longitudinally aligned inside said case and allows said second lower corner of each transaction card to extend through said lower opening when said upper corners of said transaction cards extend through said side opening.

2. The holder for holding multiple transaction cards as recited in claim 1, further including a finger slot formed on said case.

3. The holder for holding multiple transaction cards as recited in claim 1, further including a finger slot formed on said case.

4. The holder for holding multiple transaction cards, as recited in claim 1, further includes a lever arm pivotally connected to said case, said lever arm includes a handle arm near said top surface of said case and a push arm perpendicularly aligned with said handle arm, said push arm extends into said card cavity and aligned parallel to side edges of said transaction cards when arranged in a stack configuration inside said card cavity, said push arm includes a distal end and a plurality of transversely aligned steps sequentially arranged with different thicknesses to form a downward incline plane towards said distal end of said push arm so that when said handle arm is lifted and said push arm is rotated inside said card cavity, each step of said plurality of transversely aligned steps moves in a different arc and presses against a side edge of one of said transactions cards located adjacent to each step and forces said one transaction card through said side opening and thereby displacing said transaction cards at different amounts through said side opening of said case.

5. The holder for holding multiple transaction cards as recited in claim 4, further including a finger slot formed on said case.

6. The holder for holding multiple transaction cards, as recited in claim 2, further including a torsion spring coupled to said lever arm.

7. A multiple transaction card holder, comprising:

a. a case including a front panel, a rear panel and an interior frame located between said front panel and said rear panel to form a card cavity configured to hold a stack of transaction cards, said case includes a side opening that communicates with said card cavity, said front panel and said rear panel each includes a diagonal aligned side edge surrounding said side opening;

b. a lever arm pivotally mounted on said case, said lever arm includes a push arm, said lever arm aligned on said case so that said lever arm extends above said case and said push arm extends into said card cavity, said push arm includes a plurality of transversely aligned steps sequentially aligned with different thicknesses, said plurality of transversely aligned steps being spaced apart on one surface of said push arm and configured to press against one transaction card in said stack of transaction cards and force part of a top edge and a lateral edge of each transaction card in said stack of transaction cards outward through said side opening at different distances; and c. a torsion spring coupled to said ever arm configured to return said lever arm to said case.

* * * * *